United States Patent [19]

Okamoto et al.

[11] 4,143,536

[45] Mar. 13, 1979

[54] METHOD OF CORRECTING ROTATIONAL SPEED OF SCREW PROPELLER

[75] Inventors: Hiroshi Okamoto; Shigetomo Matsui, both of Kobe, Japan

[73] Assignee: Kawasaki Jukogyo Kabushiki Kaisha, Kobe, Japan

[21] Appl. No.: 627,464

[22] Filed: Oct. 30, 1975

[51] Int. Cl.[2] ..... B21K 3/00

[52] U.S. Cl. ..... 72/342; 29/156.8 P; 219/153

[58] Field of Search ..... 72/342, 371; 29/156.8 P, 401 R, DIG. 24; 148/130; 219/10.43, 153

[56] References Cited

U.S. PATENT DOCUMENTS

| | | | |
|---|---|---|---|
| 2,428,825 | 10/1947 | Arnoldy | 148/130 |
| 3,704,500 | 12/1972 | Okamoto | 29/156.8 P |

*Primary Examiner*—Lowell A. Larson
*Attorney, Agent, or Firm*—Haseltine, Lake & Waters

[57] ABSTRACT

The rotational speed of a screw propeller mounted on a propeller shaft of a ship is correctively increased or decreased by locally heating the back or face side of each blade of the propeller along a plurality of paths substantially parallel to and inward from the trailing edge of the blade in a region from a radial position about of 0.5 R to the blade tip, where R is the tip radius, particularly from 0.6 to 0.7 R, and cooling the parts thus locally heated thereby to form wash-back in each blade between the trailing edge and the heating paths thereof as a result of angular deformation accompanying plastic deformation due to the heating and cooling and thereby to decrease or increase the effective pitch of the propeller.

1 Claim, 4 Drawing Figures

METHOD OF CORRECTING ROTATIONAL SPEED OF SCREW PROPELLER

BACKGROUND

This invention relates generally to fixed-pitch, screw propellers for marine use and more particularly to correction of rotational speeds of these propellers mounted on the propeller shafts of ships. More specifically, the invention relates to improvement in a method of correcting the rotational speed of such a propeller by adjusting the effective pitch thereof.

As is well known, a fixed-pitch screw propeller installed on a ship is initially suitable for the hull and engine of that ship, but the resistance to its rotation inevitably increases after the elapse of a number of years from the start of its operational service, although there are differences in the degree of this increase. In general, this phenomenon is caused by the combined effect of an increase in the hull frictional resistance due to fouling or roughening of the underwater outer surface of the hull and an increase in the propeller torque due to changes such as fouling of the surfaces of the propeller. As a result, in order to maintain the rotational speed of that propeller exactly as before, a correspondingly larger torque of the main engine, that is, output, becomes necessary.

This so-called "torque rich" phenomenon inevitably occurs to a greater or less degree without exception in a ship fitted with a fixed-pitch screw propeller irrespective of the type of the main engine, as mentioned hereinabove. When it does occur, the mean effective pressure (m.e.p.) and exhaust gas temperature of the main engine become high, especially in a diesel driven ship, and there is a possibility of the engine becoming overloaded. Accordingly, in order to prevent this state, output control becomes unavoidable, and consequently the payability of continuous operation drops remarkably.

In this connection, the magnitude of this "torque richness" may be considered, as a practical value, to be of an order corresponding to from 3 to 4 percent of the initial torque. In most cases, moreover, it may be said that the magnitude of required correction (increase) of the rotational speed is of the order of from 3 to 4 rpm.

The case where, in a ship undergoing sea trials upon being completed and prior to delivery, the torque required for turning the propeller is found to be greater than that expected (torque rich) or, conversely, less than that expected (torque poor) cannot be said to be nonexistent, although it is very rare.

Such a state wherein the required torque is greater or less than the expected torque at the time when the ship is newly built is due principally to a cause such as a miscalculation of the relation between engine power and speed of the ship, unsuitable estimation of the wake coefficient, or unsuitable value of transmitted power. Irrespective of the principal cause, however, it can be stated that the propeller is inappropriate for the hull and the engine at that a pitch which is too large or is too small is indicated.

As measures for overcoming the difficulties due to such a state, for example, a torque rich state, two corrective methods have heretofore been generally practiced. In the first of these methods, the propeller pitch is left as it is, and the blade tips are cut off thereby to reduce the diameter of the propeller. In the second method, the effective pitch of the propeller is appropriately reduced by mechanically imparting a twist to all blades of the propeller by a hot-working process.

In order to carry out a desired correction of the rotational speed by the above first method, however, it is necessary to cut off the blade tips to an appreciable extent and, moreover, to carry out considerable working and shaping operations, whereby much labor and other costs are incurred. In addition, as a result of the reduction in the total blade area, undesirable cavitation readily occurs, and the propeller efficiency decreases. Consequently, even if the adjustment and increase of the propeller rotational speed is thus attained, this method entails undesirable results such as a remarkable drop in the speed of the ship.

In the actual practice of the above second method, various difficulties are encountered. For example, it cannot be carried out in a dock. This method, when carried out, not only entails time, labor, and other high costs but also is accompanied by other serious problems relating to strength and material such as the effects of residual stress due to twist working of the blades.

In view of the above described problems, we have previously proposed a method, as disclosed in the specification of Japanese Pat. Publn. No. 36589/1972, by which the effective pitch of a propeller can be appropriately reduced with almost no lowering of the propeller performance and with the propeller installed on the propeller shaft of a ship. Moreover, this method can be carried out with relative ease and with little labor even with the ship in an afloat state. Accordingly, it is apparent that this proposed method is superior by far to the above described two known corrective methods and has great utilization value.

In this proposed method, however, in order to vary the shape of the blade cross section, the work of cutting the trailing edge of each blade along the blade outline, albeit within a limited range, and at the same time of machining and shaping the blade face or pressure side into a fair curved surface thereby to provide a suitable washback is necessary.

SUMMARY

It is an object of this invention to eliminate completely certain disadvantageous features and inadequacies in the above-mentioned method of correcting rotational speed wherein the trailing edges of the propeller blades are cut and a suitable wash-back is imparted to the face side of each blade thereby to reduce the effective pitch of the propeller.

According to this invention, briefly summarized, there is provided a method of correcting the rotational speed of a fixed-pitch screw propeller which comprises locally heating each blade of the propeller on the back or face side thereof along a plurality of paths substantially parallel and inward from the trailing edge of the blade in a region at a radial distance of approximately 0.5 R from the propeller shaft axis, where R is the tip radius of the blade, to the blade tip, particularly the region from 0.6 R to 0.7 R, and cooling the parts thus locally heated thereby to form wash-back in the region of the blade between the trailing edge and the heating paths as a result of angular deformation accompanying plastic deformation due to the heating and cooling and thereby to vary the effective pitch of the propeller. The heating being carried out by linear heating with gas torch flames along the heating paths or by weld depositing weld beads along these paths, the parts of the beads projecting above the blade surface being subsequently machined off, and the blade surface being smoothly finished to a fair curve surface.

The nature, utility, principle, and further features of this invention will be apparent from the following detailed description with respect to a specific example of preferred embodiment of the invention wherein welding beads are utilized when read in conjunction with the accompanying drawing, in which like parts are designated by like reference numerals and characters.

DRAWING

Figure 1:
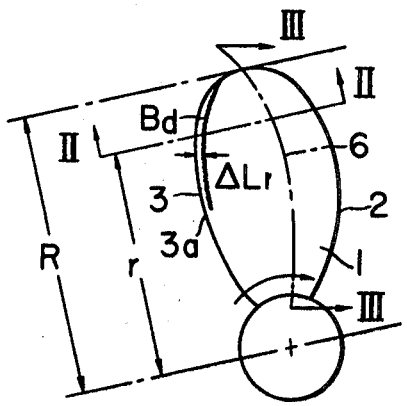
FIG.1 is an axial view from aft showing the outline of a blade of a screw propeller for a description of the principle of the method according to this invention.
Figure 2:
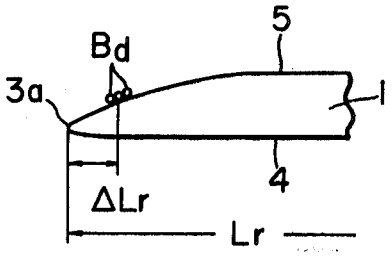
FIG. 2 is a relatively enlarged, fragmentary, cross section taken along the plane indicated by line II—II in FIG. 1, as viewed in the arrow direction, in a region in the vicinity of and including the trailing edge of the blade.
Figure 3:
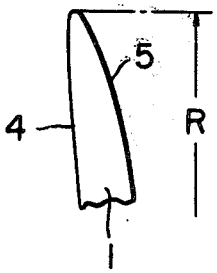
Figure 4:
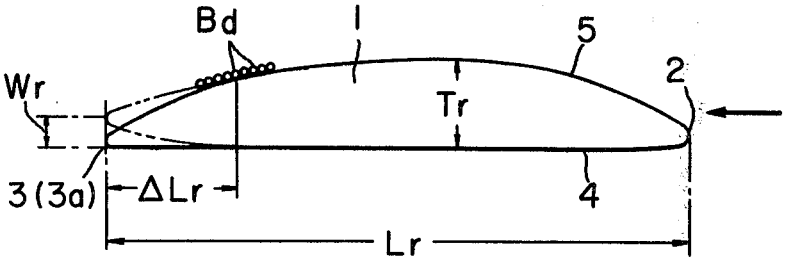

FIG. 3 is a relatively enlarge, fragmentary section taken along the surface indicated by line III—III in FIG. 1, as viewed in the arrow direction, in a region in the vicinity of and including the blade tip; and FIG. 4 is a relatively enlarged cross section taken along the plane along the line II—II in FIG. 1, as viewed in the arrow direction, indicating in an exaggerated manner the shapes of the trailing edge of the propeller blade before and after correction of the propeller rotational speed in accordance with the method of this invention.

DETAILED DESCRIPTION

Referring to the drawing, the blade 1 shown therein of a fixed-pitch screw propeller of a tip radius R has a leading edge 2, a trailing edge 3, a face or pressure side surface 4, and a back or suction side surface 5. In FIG. 1, line III—III, that is, line 6, is a curve resulting from a plot of the positions of maximum thicknesses Tr in cross sections parallel to the circumferential direction of the blade 1. The chord, i.e., the blade cross section chord length, at a position of a radius r (where $r \leqq R$), i.e., at the cross section of line II—II, is denoted by Lr.

In accordance with this invention, a bead Bd is formed on the back side surface, for example, of the blade 1 parallelly to the outline 3*a* of the trailing edge 3 of the blade along a suitable number of rows by linear local heating with gas or by TIG (inert gas shielded, tungsten arc) or MIG (inert gas shielded, metal arc) welding. The distance from the outline 3*a* in a cross section at the radial position r to the central point with respect to the total width of this bead Bd is designated by ΔLr. Furthermore, a reflex setback or wash-back is formed at the blade trailing edge by an angular deformation (transverse bending) accompanying local, hot plastic deformation. The quantity of this setback or wash-back in a cross section at the radial position r is denoted by $W_r$.

The particulars and results in an instance where the method of this invention was carried out in practice respectively by the linear heating technique with gas torch, which, itself, is known and in common use, and by the technique of bead forming by TIG welding with respect to two actual ships X and Y which have become torque rich are set forth in the following table. In this table, the meanings of the radii, blade widths, and blade thicknesses of the propellers and other particulars are as set forth in the foregoing description and drawing, and quantities such as blade width, maximum thickness, distance from the blade trailing edge outline 3*a* to the central point of the total width of the gas linear heating or weld bead, and the quantity of the wash-back formed by angular deformation in the blade cross section at the radial position $r = 0.7$ R are representatively set forth.

The nozzle number of the torch used in this case was TANKAKA-LPG No. 3,6650; the height of the nozzle tip was approximately 25 to 30 mm.; the flame traveling speed was 150 mm./min. (water cooling at 5 liters/min. being carried out from approximately 150 mm. behind). The weld deposited material in the TIG welding was TGS-CAN, manufactured by Kobe Steel Ltd. (corresponding to ERCuAL-A2 of AWS) and was of 2.4-mm. diameter.

| PARTICULAR | SHIP: TYPE: X Oil tanker (120,000 t.) | Y Motorcar carrier (10,900 t.) |
|---|---|---|
| Length between perpendiculars (Lpp) | 260.0 m. | 180.0 m. |
| Breadth moulded (Bm) | 42.0 m. | 24.0 m. |
| Main engine — | | |
| Type | diesel | diesel |
| Output × rotational speed (N) (M. C. R.) | ps. rpm 26,100 × 122 | ps. rpm. 18,400 × 118 |
| Screw propeller — | | |
| Number of blades | 5 | 6 |
| Radius (R) | 3,300 mm. | 2,900 mm. |
| Blade width (L 0.7 R) | 1,987 mm. | 1,652 mm. |
| Blade thickness (T 0.7 R) | 106.5 mm. | 74.3 mm. |
| Material | Ni,Al bronze | Ni,Al bronze |
| Heating method | gas torch, linear heating | TIG welding bead |
| Propane gas pressure, flow rate | 0.8 kg/cm², 28 liters/min. | |
| Oxygen pressure, flow rate | 7.6 kg./cm², 140 liters/min. | |
| Electrode rod diameter | | 4.0 mm. |
| Welding current, arc voltage | | 280 A., 22 - 25 V. |
| Total width, number of rows of heating paths, beads | 40 mm., approx, 4 | 72 mm., 9 |
| Distance ΔLr from trailing edge of line to central point of total width of heating paths or beads | 40 mm. | 60 mm. |
| Required rotational speed correction (ΔN) | +2.0 rpm. | +3.0 rpm. |
| Rotational speed correction ratio (ΔN/N × 100) | +1.6% | +2.5% |
| Quantity of wash-back formed at | 3.5 mm | 9.0 mm. |

-continued

| PARTICULAR | SHIP: TYPE: | X Oil tanker (120,000 t.) | Y Motorcar carrier (10,900 t.) |
|---|---|---|---|
| blade trailing edge (W. 0.7 R) | | | |

As is apparent from this table, it was possible, in the case of the oil tanker X, to form a wash-back of 3.5 mm. and to raise the rotational speed of the propeller with the output (MCR) of the pertinent main engine by approximately 1.6 percent up to the sepcified value, and this result was accomplished by applying a total of four gas flames at a traveling speed of approximately 150 mm./min. over the back side surface of each blade 1 substantially parallelly to the trailing edge outline 3*a*, the gas flames being ejected from four nozzles (spaced at 10 mm. between centers), two of which were disposed on each opposite side of a point, in a blade cross section at a radius 0.7 R, 40 mm. from the trailing edge outline 3*a* (corresponding to 2.0 percent of the blade width), and by utilizing the resulting local plastic deformation of the blade at the linear heated part.

The weld bead in the bead weld depositing method (including cases techniques such as MIG welding), which is one of the process for practicing the method of this invention, is not applied for the purpose of connecting the propeller blade, of course. Accordingly, after this bead has served its purpose of effecting correction of the propeller speed, the protruding parts of the bead are removed by machining and the bead line parts of the blade surface are finished smooth. However, in order to prevent embrittlement, cracking, splitting, and other defects due to the effect of heating and deterioration of properties such as toughness, mechanical properties, fatigue strength, and corrosion resistance, it is desirable that the welding be carried out by a welding process and under welding conditions that are recommended or recognized as being optimum for the material of the pertinent propeller blades, that is, metals of the so-called propeller metal type such as manganese bronze and aluminum bronze.

In the example of practice with respect to the above mentioned ship Y, nine continuous beads Bd were deposited on the back side 5 of each blade 1, but in some cases, these beads may be intermittent.

Furthermore, by applying linear heating by gas flame or weld depositing beads Bd by the above described procedure on the face side 4 instead of the back side 5, a setback or wash-back of a specific quantity is formed on the back surface 5 of the blade trailing edge, and it is possible to reduce the rotational speed as a result of an increase in the effective pitch and, at the same time, to cause the designed output to be fully produced.

In the practice of the method of this invention, the quantity of wash-back (W 0.6 to 0.7 R) to be formed on the face side or the back side of the trailing edge region of the blade surface at the radial position 0.6 R or 0.7 R is first determined from the required quantity of correction of the propeller rotational speed. Then, on the basis of this quantity of wash back, in the case of the gas linear heating process, particulars such as the heating position, number, and total width of heating lines, the kind of gases (propane and oxygen, acetylene and oxygen, etc.), the mixture ratios, flowrates, and pressures of these gases, the shape and dimensions of the torch nozzles, the height (distance) of the nozzle tips, and traveling speed (heating rate) of the nozzles are determined with full consideration also of the thickness and material properties of the blades 1 in the vicinity of the heating position. In the case of the bead weld depositing process, particulars such as the bead positions, the required quantity of heat input for welding, number and total width (quantity deposited) of the beads, and welding method and conditions (arc voltage, current, diameter and material of welding rod, and welding speed) are determined with full consideration also of the thickness and material properties of the blades 1 in the vicinity of the parts where the welding beads are to be deposited.

However, as a result of our numerous investigations and from various examples, it is our conclusion that there is not much relation between the required correction of the rotational speed of a ship and particulars such as the type and size of that ship and output of the main engine thereof, and that the correction is ordinarily of the order of 3 to 4 rpm. Further, it may be considered that the generally standard value of the quantity of wash-back formed principally on the face surface 4 of the blade trailing edge region is within the range of 5 to 10 mm. in a cross section of 0.6 to 0.7 R, at which this value is a maximum.

In this connection, the distance $\Delta Lr$ of the position where gas linear heating or bead weld depositing is to be carried out from the blade trailing edge outline 3*a* has, of course, a close relationship with factors such as the blade thickness in the vicinity of this region, kind and flow rate of the gas, number and total width of lines of heating, speed of application of heat, diameter of the welding rod, value of welding current, welding speed, and number of beads. However, if these factors are kept constant, the quantity of wash-back will increase, as a natural consequence, when this distance $\Delta Lr$ is increased within practical limits, and there will be a tendency of the rate of increase of the propeller rotational speed also to increase.

We have found further that, when a wash-back is formed on and imparted to the trailing edge of each blade in the region from the vicinity of the 0.5 R position toward the blade root, this imparts almost no contribution to an increase in the effective pitch, in other words, to a corrective effect on the rotational speed.

Accordingly, the objective correction can be effectively achieved in the practice of this invention, upon full consideration of the linear gas heating conditions or bead weld depositing conditions and other related particulars, by appropriately determining the distances $\Delta Lr$ at 0.6 R to 0.7 R positions corresponding to the desired Wr at 0.6 to 0.7 R positions in blade cross sections at 0.6 to 0.7 R positions and causing the quantity of wash-back Wr to decrease gradually in a fair-curve manner to zero in both of the regions from the 0.6 to 0.7 R positions substantially to the 0.5 R position and toward the blade tip by, for example, reducing gradually the distance $\Delta Lr$ or, without changing the distance $\Delta Lr$, gradually increasing the speed of travel of the linear heating as torch or the bead welding speed.

As will be apparent from the foregoing disclosure, this invention is characterized in that linear gas heating or bead weld depositing is carried out on the back side (or face side) of each blade of a screw propeller along suitable paths parallel to and inward from the trailing edge outline of the blade substantially from a radial position 0.5 R, where R is the blade tip radius, to a region in the vicinity of the blade tip, whereby an angular deformation due to localized plastic deformation is imparted to the blade thereby to form a specific wash-back at the trailing edge part, and the effective pitch of the propeller is decreased (or increased). Owing to the nature of this method, lowering thereby of the propeller rotational speed is relatively easy, and, moreover, the range within which correction of the rotational speed is possible is considerably wide, being of the order of from ±5 to ±10 rpm. or more, which is very convenient and useful in practice.

Similarly as in the method previously disclosed in the aforementioned Japanese Pat. Publn. No. 36589/1972, correction of the propeller rotational speed by the method of this invention is accomplished with almost no lowering of the performance of the propeller. Furthermore, this correction work in accordance with this invention can be carried out with the propeller mounted on the propeller shaft of the ship and, moreover, with the ship in afloat state on water, whereby this work is further simplified and facilitated. Particularly in the case of the linear gas heating process, the work of machining off of the raised beads and smooth finishing of the blade surface after the corrective work is unnecessary, whereby this process can be said to be more advantageous than the bead weld depositing process. By either process, great reductions in required labor and other costs are afforded.

We claim:

1. A method of correcting the rotational speed of a screw propeller having a blade (1) which has a back side (5), a face side (4), and a trailing edge (3) of an outline (3*a*), which method comprises locally heating the blade on one of the back and face sides (5), (4) along a plurality of paths substantially parallel to the outline (3*a*) and at an average distance ΔLR inward therefrom, while at the same time locally cooling the blade on the other side along said paths, and naturally cooling the parts thus locally heated thereby to form wash-back of a magnitude Wr in the region of the blade between the trailing edge and the heating paths as a result of angular deformation accompanying plastic deformation due to the heating and cooling and thereby to vary the effective pitch of the propeller, the blade being thus locally heated on the back side (5) when it is desired to decrease the effective pitch thereby to increase the rotational speed of the propeller, the blade being thus locally heated on the face side (4) when it is desired to increase the effective pitch thereby to decrease the rotational speed, said blade being distorted for correcting the rotational speed of said screw propeller, said heating and cooling steps being carried out along a plurality of paths substantially parallel to the outline of the trailing edge of the blade, said heating and cooling steps comprising differential heating along said paths at a predetermined distance inward from the outline of said trailing edge to be displaced by a predetermined distance, said blade being locally heated by weld depositing weld beads along said paths, the parts of the beads projecting above the blade surface being subsequently machined off, and the blade surface being smoothly finished to a fair curve surface.

* * * * *